US008827039B2

(12) United States Patent
Monnig

(10) Patent No.: US 8,827,039 B2
(45) Date of Patent: Sep. 9, 2014

(54) LIGHT WEIGHT CLIMBER PAD

(75) Inventor: Matthew Monnig, Fullerton, CA (US)

(73) Assignee: Spyder Manufacturing, Inc., Placentia, CA (US)

( * ) Notice: Subject to any disclaimer, the term of this patent is extended or adjusted under 35 U.S.C. 154(b) by 94 days.

(21) Appl. No.: 13/548,692

(22) Filed: Jul. 13, 2012

(65) Prior Publication Data

US 2014/0014440 A1 Jan. 16, 2014

(51) Int. Cl.
*A63B 27/00* (2006.01)

(52) U.S. Cl.
USPC ..... 182/221; 182/134

(58) Field of Classification Search
USPC ..... 182/221, 133
See application file for complete search history.

(56) References Cited

U.S. PATENT DOCUMENTS

| | | | | | |
|---|---|---|---|---|---|
| 1,150,372 | A | * | 8/1915 | Jones | 182/221 |
| 1,727,237 | A | * | 9/1929 | Katz | 182/221 |
| 2,297,136 | A | * | 9/1942 | Detering | 182/221 |
| 3,640,358 | A | * | 2/1972 | Smith | 182/221 |
| 4,681,097 | A | * | 7/1987 | Pansiera | 602/16 |
| 4,938,313 | A | | 7/1990 | Rullo et al. | |
| 4,993,515 | A | | 2/1991 | Green et al. | |
| 5,016,734 | A | | 5/1991 | Greenway | |
| 5,853,067 | A | * | 12/1998 | Cutler | 182/221 |
| 6,148,959 | A | * | 11/2000 | Shay | 182/221 |
| 6,578,668 | B2 | * | 6/2003 | Haltom | 182/221 |
| 6,926,687 | B2 | * | 8/2005 | Shields | 602/24 |
| 7,727,173 | B2 | * | 6/2010 | Rooney | 602/23 |
| 2007/0095193 | A1 | * | 5/2007 | May | 84/421 |

OTHER PUBLICATIONS

Wesspur Tree Equipment, Inc., "Buckingham Steel Spurs with T Pads & Tree Gaffs", Internet online catalog web page, downloaded Dec. 7, 2011, URL: http://wesspur.com/Spurs/climbers/spu101t.html.

* cited by examiner

*Primary Examiner* — Alvin Chin-Shue
(74) *Attorney, Agent, or Firm* — Fulwider Patton LLP

(57) ABSTRACT

A lightweight pad system for a climber is disclosed having a bracket with a curved portion in the shape of a "C" and ends including elongate slots for receiving a strap. The bracket has a recessed columnar channel extending below the lower edge of the plane of the plate, the channel forming an angle with the lower edge in a range of between seventy two degrees and seventy five degrees. Hook and loop fastener is affixed to the "C" shaped plate between a first end and the channel, and a strap passes through the bracket for adjusting the fit of the pad assembly. Inside the bracket is a removable pad having a "C" shape corresponding with the curved plate, the removable pad having a back surface comprising complimentary hook and loop fastening material cooperating with the first hook and loop fastener material to achieve a releasable attachment with the bracket.

12 Claims, 3 Drawing Sheets

LIGHT WEIGHT CLIMBER PAD

BACKGROUND OF THE INVENTION

The present invention relates to a tree or pole climber commonly used by arborists or utility workers, and more particularly relates to a two piece pad assembly for a tree or pole climber having a removable, washable foam pad that releasably couples to an aluminum bracket, providing both improved protection and convenience in the use of available climber assemblies in use today.

Tree or pole climbers typically are formed from a metal rod that is formed to have an upper calf bracket portion and a lower "J" shaped stirrup or hook shaped bracket portion, with the upper calf bracket portion being configured to be strapped to a user's calf over a boot, and the lower "J" shaped stirrup or hook shaped bracket portion being configured to be strapped to the user's foot. The lower "J" shaped stirrup or hook shaped bracket portion is also typically configured to have one or more spurs or gaffs affixed to the lower "J" shaped stirrup or hook shaped bracket portion, arranged to be angled outwardly so as to engage the tree or pole. The upper and lower bracket portions each can be formed with different angles and configurations to suit the particular user or the intended use of the climber. Such climbers are also typically formed as one piece of a variety of materials, such as steel, aluminum or titanium, for example, with each material having desirable properties of strength, durability and weight. The climber is traditionally used with a pad that protects the user's calf and knee as the upper portion of the "J" shaped rod bears against these body parts. Pad assemblies can be leather or metal brackets, often with foam or cloth attached to the interior surface that further protects the wearer. However, these one piece pad units are typically heavy, and can become heavier with perspiration, moisture, It would also be desirable to provide a pad assembly for a climber that has two pieces, a soft lightweight removable pad that releasably attaches to a bracket, which straps around the user's leg. The present invention meets these and other needs.

SUMMARY OF THE INVENTION

The present invention is a pad assembly for use with a climber that is lightweight and more versatile than existing pad assemblies. The unique construction of the present invention makes it lighter than existing pads, but also eliminates the need for a separate adjustment sleeve found on other adjustment pad assemblies. Rather, the present invention satisfies the adjustment features without a separate sleeve. The removable pad is easily affixed to the bracket, but can be separated and washed easily.

The pad assembly of the present invention is characterized by a lightweight bracket with a curved portion in the shape of a "C" and ends including elongate slots for receiving a strap thereinthrough. The bracket also has a recessed columnar channel extending below the lower edge of the plane of the plate, the channel forming an angle with the lower edge in a range of between seventy two degrees and seventy five degrees. The channel is used to receive the top portion of the J shaped climber, and includes holes that cooperate with fasteners to secure the climber to the bracket. In a preferred embodiment, a sheet of hook and loop fastener is affixed, such as by adhesive, to the inner surface of the "C" shaped plate between a first end and the recessed channel, and a strap passes through one of bracket for adjusting the fit of the pad assembly. Inside the bracket is a removable pad having a generally "C" shape corresponding with the curved portion of the plate, the removable pad having a back surface comprising complimentary hook and loop fastening material cooperating with the sheet of hook and loop fastener material to achieve a releasable attachment with the bracket.

These features, and others, will best be understood with reference to the included drawings identified below in conjunction with the detailed description of the preferred embodiments set forth below.

DETAILED DESCRIPTION OF THE PREFERRED EMBODIMENTS

Figure 1:
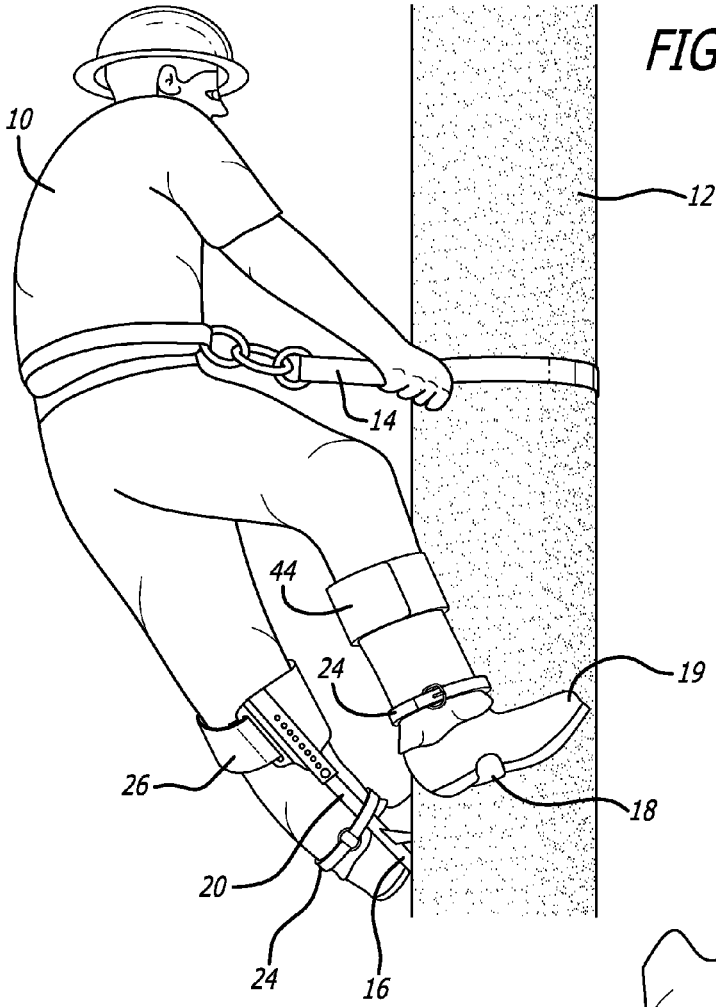
FIG. 1 is a perspective view of a lineman using an embodiment of the present invention in conjunction with a climber.
Figure 2:
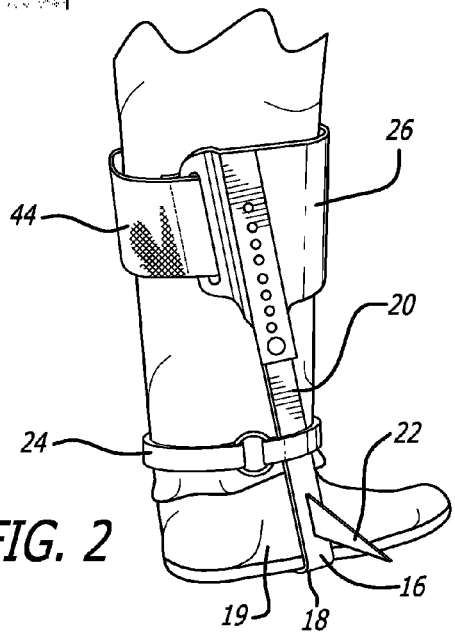
FIG. 2 is an elevated perspective view of the climber and pad assembly of the present invention.
Figure 3:
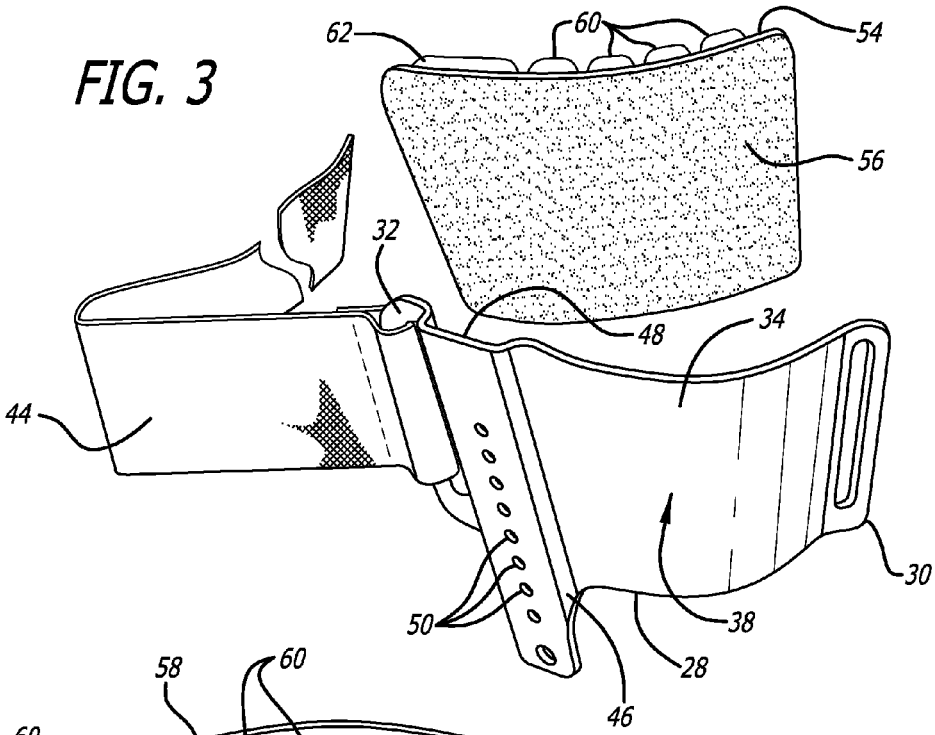
FIG. 3 is an elevated, perspective exploded view of the bracket and pad of the pad assembly of the present invention.
Figure 3:
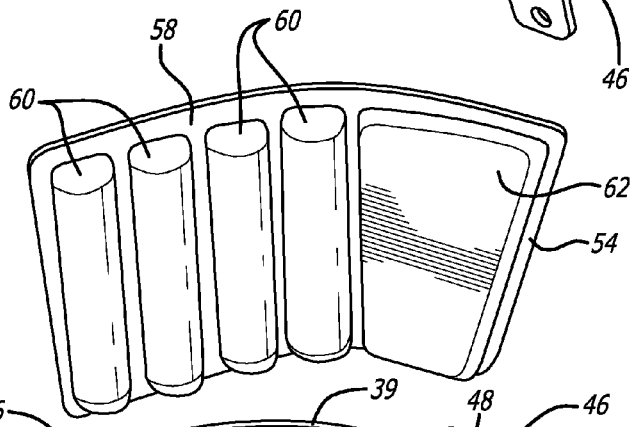
Figure 4:
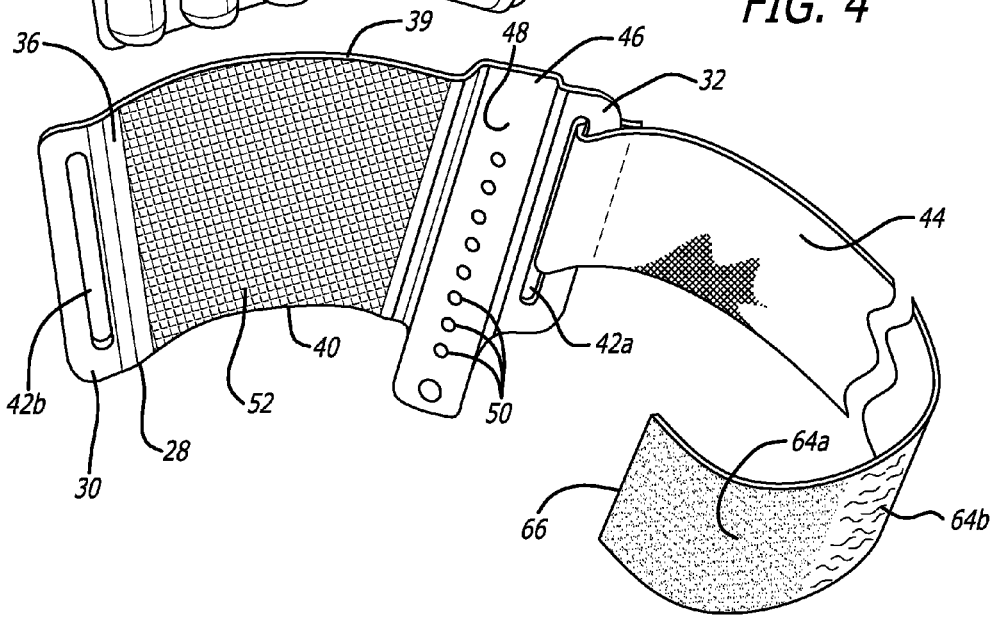
FIG. 4 is another elevated, perspective exploded view from the reverse side of the bracket and pad of the pad assembly of the present invention.
Figure 5:
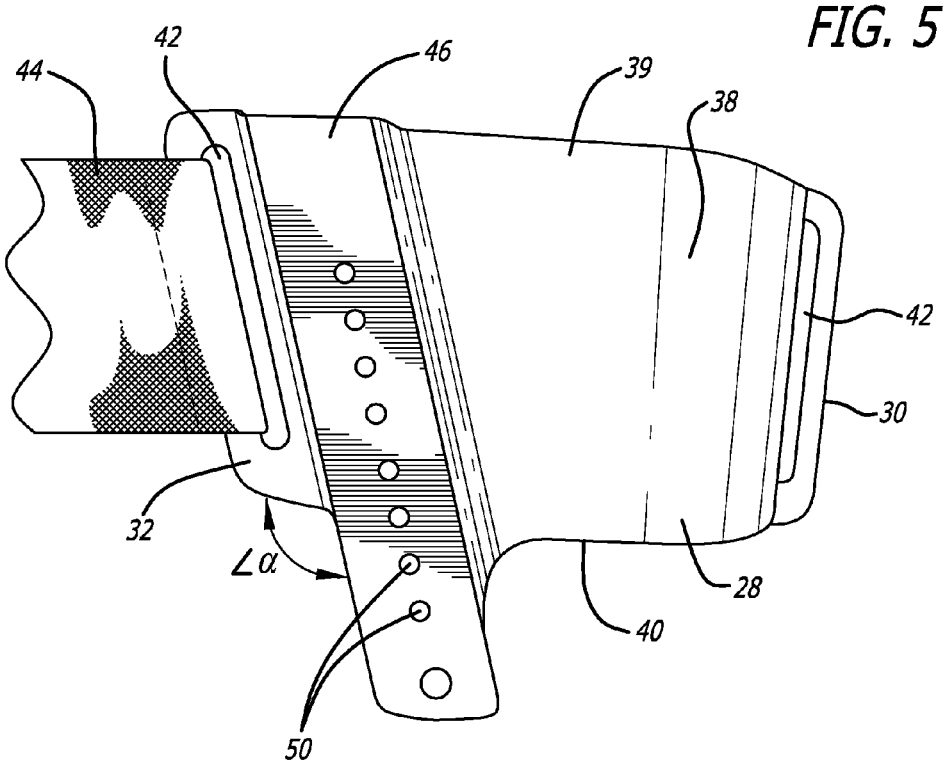
FIG. 5 is a front view of the bracket and strap of the pad assembly of the present invention.
Figure 6:
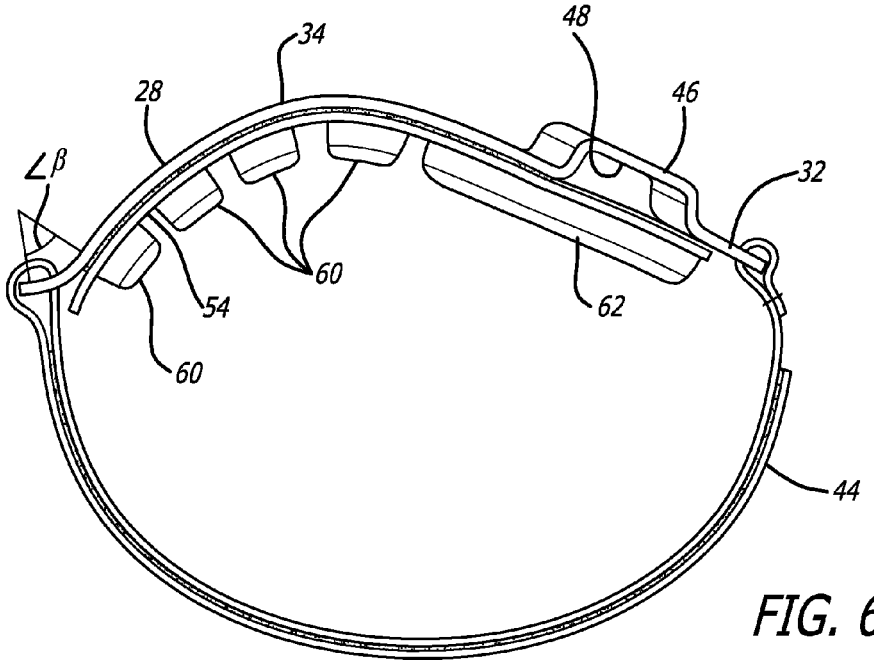
FIG. 6 is a top view of the bracket and pad of the pad assembly of the present invention.

The present invention is directed to a pad assembly that is used with a climber to protect and comfort a user while wearing the climber. FIG. 1 illustrates a user 10 ascending a pole 12 using a harness 14 and a pair of climbers 16. Climbers 16, as shown in FIG. 2, are generally comprised of a steel rod formed into a "J" shaped configuration, with a top portion 20 used to connect the climber to the pad assembly 26 and the bottom portion 18 forming a stirrup for retaining the user's foot 19. A gaff 22 is formed with the climber 16 to engage the pole 12 as is known in the art. Typically, an ankle strap 24 will be wrapped around the climber's upper portion 20 and the leg of the user 10 as shown in FIGS. 1 and 2 to help stabilize and secure the climber.

The pad assembly 26 is shown with greater detail in FIGS. 3-6, and includes a bracket 28 that is formed from a plate, such as steel or some other high strength material. The bracket 28 includes a first end 30 and a second end 32, and an upper edge 39 and lower edge 40. The bracket 28 is formed with a curved, generally "C" shaped section 34 that is sized to accommodate a portion of a user's calf. The curved portion 34 defines an inner surface 36 and an outer surface 38, and the inner surface receives a sheet of hook and loop fastener material 52 for securing a pad 54 thereto. The pad 54 is a light weight, washable foam pad that has a back surface made from, or covered with, complimentary hook and loop fastener material 56 that cooperates with the hook and loop fastener material 52 to releasably engage and secure the pad 54 to the bracket 28. The pad 54 can be flexible, and will in a preferred embodiment have a "C" shape that approximates the "C" shape of the bracket to aid in placing and securing the pad 54 to the bracket 28. The pad 54 can further be formed with a plurality of cushions, such as elongate cushions 60 projecting from a front surface 58. The cushions 60 are spaced apart to allow the pad 54 to be bent or curved into the desired "C" shape without interference from adjacent cushions 60. In a preferred embodiment, the pad will also include a larger cushion 62, such as a trapezoidal cushion with a longer top edge than a bottom edge to give the pad a slight conical shape for better fit with a human calf. A strap 44 passes through a first end 32 at an elongate slot 42*a* and is preferably sewn thereto to form a permanent attachment for the bracket, and includes complimentary hook and loop fastening material 64*a*, 64*b* at a distal end of the strap 44. The distal end 66 of the strap 44 is passed through the second end 30 of the bracket 28 at elongate slot 42*b* and then doubled back upon itself until the proper fit is achieved. The complimentary hook and loop fastener materials 64*a*, 64*b* will be aligned and engage to retain the strap 44 in the desired position. The end 30 of the bracket 28, in a preferred embodiment, will be angled out of plane by an angle β equal to approximately forty-five degrees to facilitate the strap 44 passing through the elongate slot 42*b*.

To retain the upper portion 20 of the climber 16, the bracket 28 is formed with a recessed channel 46 in the shape of a column that is sized to receive the bar of the climber. The recessed channel 46 includes a plurality of spaced apart apertures 50 that receive fasteners (not shown) for locking the climber 16 to the bracket 28. The recessed channel 46 ensures that the fasteners to not bear against the user's leg as the pad assembly 26 is tightened about the user. The recessed channel, in a preferred embodiment is angularly offset from the lower edge 28 of the bracket such that it extends below the lower edge 28 at an angle α of approximately seventy-two to seventy-five degrees, and more preferably seventy-three and a half degrees.

The pad 54 is preferably made of a light weight, washable foam material with a synthetic covering that allows it to be removed from the pad assembly 28, readily washed, and returned to the pad assembly quickly and easily. The foam is preferably one that retains its shape after many such washings, and can dry quickly. The interchangeability of the pads also allows for old pads to be replaced with new pads without the need to purchase an entire pad assembly. Moreover, the use of the bracket 28 and pad 54 in conjunction with the strap 44 enables the system to be used without a separate adjustment sleeve that is traditionally used with such pad assemblies. This not only greatly simplifies the pad assembly, but dramatically reduces the weight of the pad assembly, which is important when performing repeated climbing operations where fatigue plays a role in accidents to the user.

It will be apparent from the foregoing that while particular forms of the invention have been illustrated and described, various modifications can be made without departing from the spirit and scope of the invention. Accordingly, it is not intended that the invention be limited, except as by the appended claims.

I claim:

1. A pad system for a climber, comprising:

a bracket formed from a single plate having first and second ends, the plate having a curved portion in the shape of a "C" defining a plane with an inner surface and an outer surface, and top and bottom edges, the first and second ends respectively including elongate slots for receiving a strap thereinthrough, the bracket further comprising a recessed columnar channel having a wall member offset from the plane defining the "C" shaped plate, the channel extending below the bottom edge of the curved portion of the plate, the channel forming an angle with the bottom edge of the curved portion of the plate in a range of between seventy two degrees and seventy five degrees, the wall member including a linear array of apertures extending along a middle portion thereof;

a sheet of hook and loop fastener material affixed to the inner surface of the "C" shaped plate between the first end and the channel;

a strap securable through one of said first and second ends; and a removable pad having a generally "C" shape corresponding with the curved portion of the plate, the removable pad having a back surface comprising complimentary hook and loop fastening material cooperating with the sheet of hook and loop fastener material to achieve a releasable attachment with the bracket, wherein the first end of the plate is angled approximately forty-five degrees out of plane with the curved "C" shaped portion of the plate.

2. The pad system of claim 1, wherein the removable pad has a front surface including spaced apart elongate cushioning members that are positioned to bear against a user's leg when the removable pad is releasably attached to the bracket.

3. The pad system of claim 2 further comprising a trapezoidal shaped cushioning member adjacent the elongate cushioning members, the trapezoidal shaped cushioning member extending substantially a height of the removable pad.

4. The pad system of claim 1, wherein the bracket is made from aluminum.

5. The pad system of claim 1, wherein the strap includes hook and loop fastening material at a distal end of the strap.

6. The pad system of claim 1, wherein the removable pad is constructed of washable foam.

7. A pad system for a climber, comprising:

a bracket formed from a single plate having first and second ends, the plate having a curved portion in the shape of a "C" defining a plane with an inner surface and an outer surface, and top and bottom edges, the first and second ends respectively including elongate slots for receiving a strap thereinthrough, the bracket further comprising a recessed columnar channel having a wall member offset from the plane defining the "C" shaped plate, the channel extending below the bottom edge of the curved portion of the plate, the channel forming an angle with the bottom edge of the curved portion of the plate in a range of between seventy two degrees and seventy five degrees, the wall member including a linear array of apertures extending along a middle portion thereof;

a sheet of hook and loop fastener material affixed to the inner surface of the "C" shaped plate between the first end and the channel;

a strap securable through one of said first and second ends; and a removable pad having a generally "C" shape corresponding with the curved portion of the plate, the removable pad having a back surface comprising complimentary hook and loop fastening material cooperating with the sheet of hook and loop fastener material to achieve a releasable attachment with the bracket; the removable pad having a trapezoidal shaped cushioning member with a upper edge aligned to the top edge of the plane of the plate and a lower edge aligned with the bottom edge of the plane of the plate, and the length of the upper edge being longer than the bottom edge, wherein the first end of the plate is angled approximately forty-five degrees out of plane with the curved "C" shaped portion of the plate.

8. The pad system of claim 7, wherein the removable pad has a front surface including spaced apart elongate cushioning members that are positioned to bear against a user's leg when the removable pad is releasably attached to the bracket.

9. The pad system of claim 8 wherein the trapezoidal shaped cushioning member is adjacent to the elongate cushioning members, the trapezoidal shaped cushioning member extending substantially a height of the removable pad.

10. The pad system of claim 7, wherein the bracket is made from aluminum.

11. The pad system of claim 7, wherein the strap includes hook and loop fastening material at a distal end of the strap.

12. The pad system of claim 7, wherein the removable pad is constructed of washable foam.

* * * * *